US005350332A

United States Patent [19]

Yu et al.

[11] Patent Number: 5,350,332

[45] Date of Patent: Sep. 27, 1994

[54] COMBINED TOY BAT AND WINDMILL

[76] Inventors: Chien P. Yu, No. 13, Lane 251, Tung Yang Rd.; I C. Yu, No. 20, Lane 492, Shui Yuan Rd., both of Feng Yuan City, Taichung Hsien, Taiwan

[21] Appl. No.: 70,263

[22] Filed: Jun. 2, 1993

[51] Int. Cl.[5] ..... A63H 33/40; A63H 1/00; A63H 1/06

[52] U.S. Cl. ..... 446/217; 446/236; 446/266; 273/67 R; 416/70 R

[58] Field of Search ..... 446/71, 176, 217, 218, 446/236, 266; 273/67 R, 76, 167 E, 167 H; D3/1-4; 416/69, 70 R, 247 R; D21/93, 96, 210-213

[56] References Cited

U.S. PATENT DOCUMENTS

| | | | |
|---|---|---|---|
| D. 199,404 | 10/1964 | Ringenback | D21/93 |
| 652,240 | 6/1900 | Bonfiglio | 416/69 |
| 2,325,913 | 8/1943 | McLemore | 416/247 |
| 4,907,800 | 3/1990 | Passamaneck et al. | 446/266 |

*Primary Examiner*—Robert A. Hafer
*Assistant Examiner*—Jeffrey D. Carlson
*Attorney, Agent, or Firm*—Fitch, Even, Tabin & Flannery

[57] ABSTRACT

A combined toy bat and windmill which has a toy windmill which is rotatably mounted in a transparent hollow bat through which a number of holes are formed, so that the toy windmill is rotated by means of air which flows through the holes when the hollow bat is swung.

7 Claims, 4 Drawing Sheets

COMBINED TOY BAT AND WINDMILL

BACKGROUND OF INVENTION

1. Field of Invention

The present invention relates to toys and particularly to a combined toy bat and windmill.

2. Related Prior Art

Toy bats are used for play and exercise. Toy windmills are used for play. However, each of them provides only limited fun. Therefore, the present invention is intended to combine them in order to provide more fun.

SUMMARY OF INVENTION

The present invention provides a combined toy bat and windmill. The combined toy bat and windmill has a toy windmill which is rotatably mounted in a transparent hollow bat through which a number of holes are formed, so that the toy windmill is rotated by means of air which flows through the holes when the transparent hollow bat is swung.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
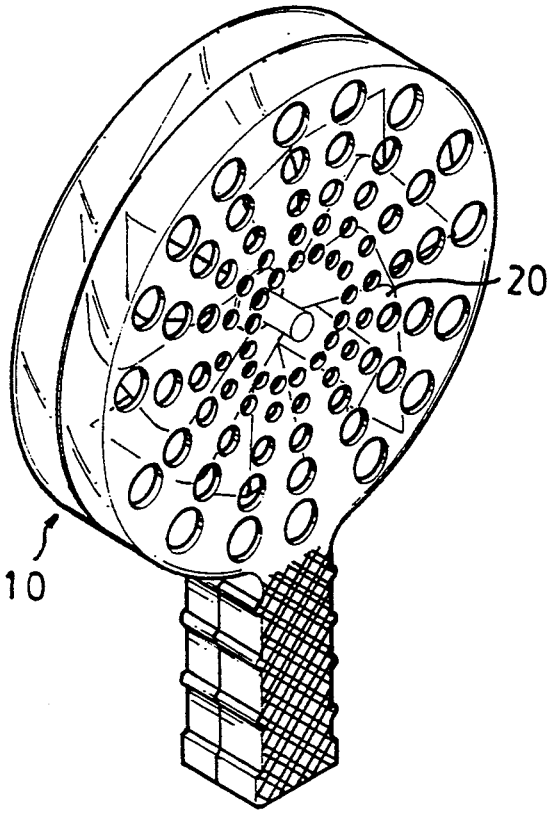
FIG. 1 is a perspective view of a combined toy bat and windmill in accordance with a first embodiment of the present invention.

Referring to FIG. 1 of the drawings, a combined toy bat and windmill has a hollow toy bat 10 wherein a toy windmill 20 is rotatably mounted.

Figure 2:
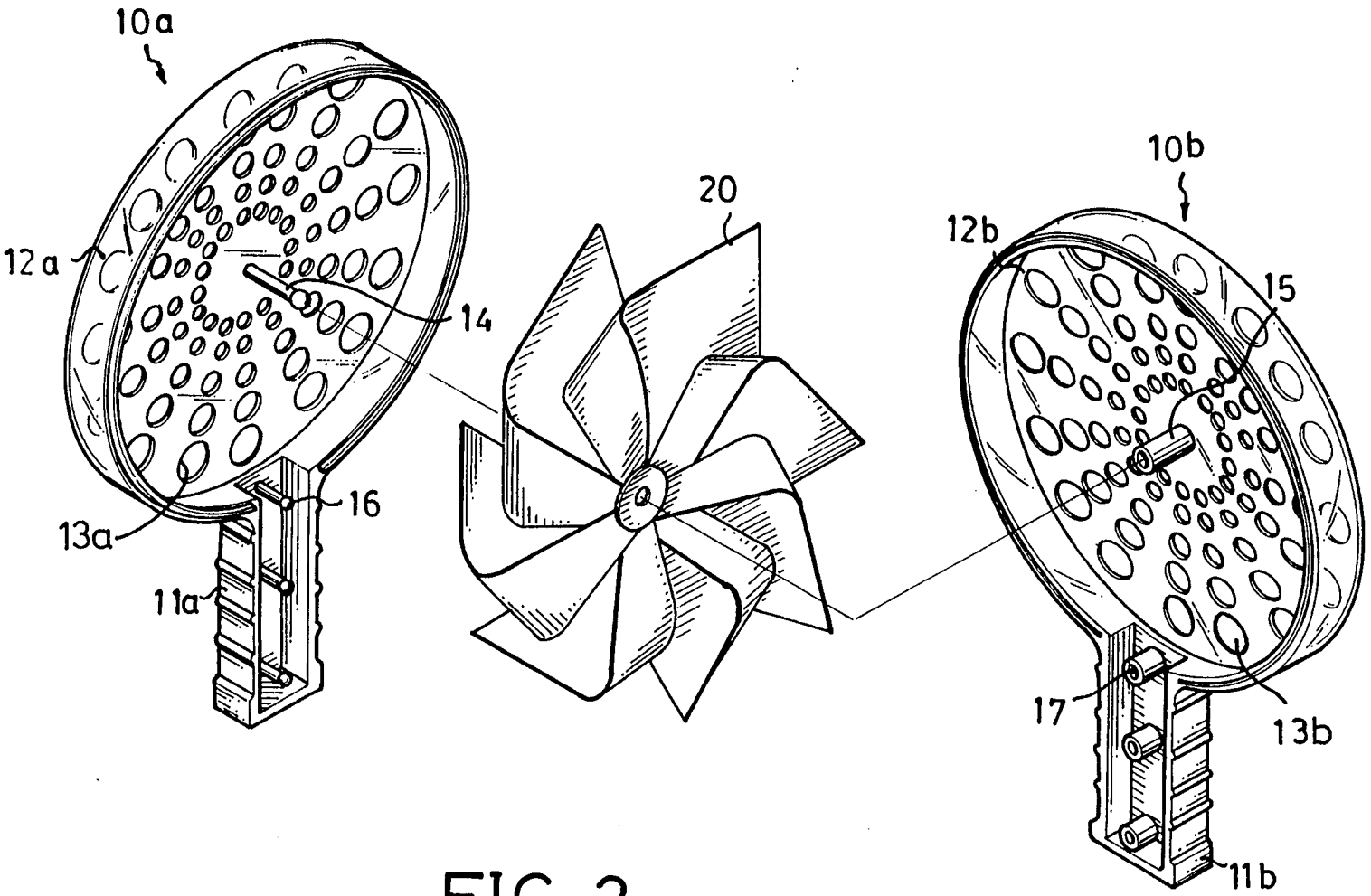
FIG. 2 is an exploded view of the combined toy bat and windmill in accordance with the first embodiment of the present invention.

Referring to FIG. 2 of the drawings, in accordance with a first embodiment of the present invention, the hollow toy bat 10 has two halves 10*a* and 10*b* which are separate from each other by a plane perpendicular to an axis about which the toy windmill 20 rotates.

The first half 10*a* has a handle 11*a* and a head 12*a*. A number of protrusions 16 are formed on the handle 11*a*. The head 12*a* is transparent. A shaft 14 is axially formed on the head 12*a*. A number of holes 13*a* are formed through the head 12*a*.

The second half 10*b* has a handle 11*b* and a head 12*b*. A number of tubular receivers 17 are formed on the handle 11*b*. The head 12*b* is transparent. A tubular receiver 15 is axially formed on the head 12*b*. A number of holes 13*b* are formed through the head 12*b*.

The toy windmill 20 has a hub through which the shaft 14 is insertable.

Figure 3:
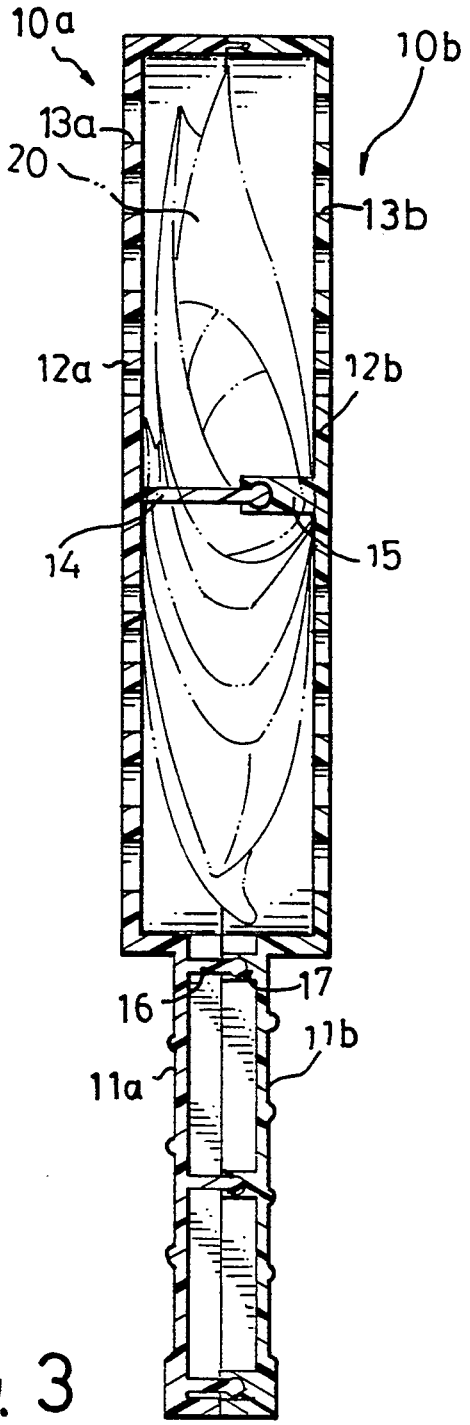
FIG. 3 is a cross-sectional view of the combined toy bat and windmill in accordance with the first embodiment of the present invention.

Referring to FIG. 3 of the drawings, the first half 10*a* is attached to the second half 10*b* by means of welding, so that the shaft 14 is received in the tubular receiver 15 and that the protrusions 16 are received in the tubular receivers 17. The toy windmill 20 is rotated by means of air which flows through the holes 13*a* and 13*b* when the combined toy bat and windmill is swung. The toy windmill 20 is visible as the heads 12*a* and 12*b* are transparent.

Figure 4:
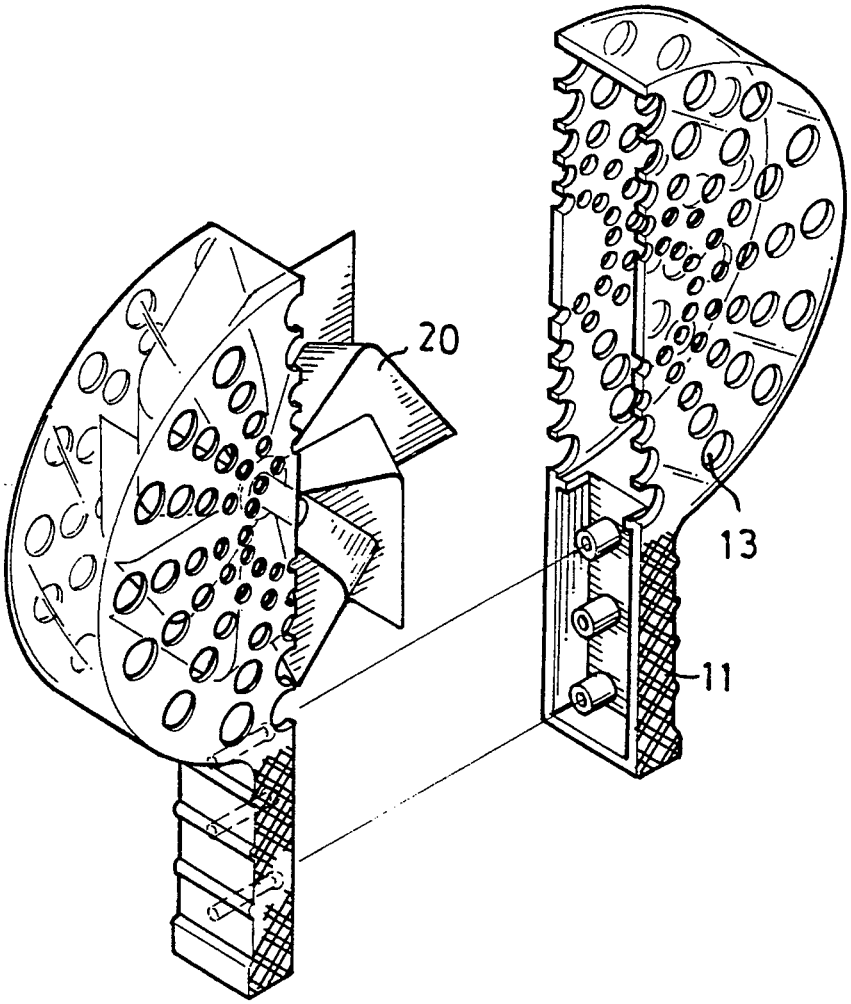
FIG. 4 is an exploded view of a combined toy bat and windmill in accordance with a second embodiment of the present invention.

Referring to FIG. 4 of the drawings, in accordance with a second embodiment of the present invention, a combined toy bat and windmill has a hollow toy bat 10 which has first and second halves which are separate from each other by a plane parallel to an axis about which the toy windmill 20 rotates. The toy windmill 20 is rotatably mounted on a shaft axially formed on the first half.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A combined toy bat and windmill comprising a toy windmill rotatably mounted in a transparent hollow toy bat through which a number of holes is formed, said hollow bat comprising first and second halves which are separate from each other along a plane perpendicular to an axis about which said toy windmill rotates, wherein said first half comprises a handle and a transparent head through which the number of holes is formed.

2. A combined toy bat and windmill in accordance with claim 1, wherein said transparent head of said first half comprises a shaft axially formed thereon for carrying said toy windmill.

3. A combined toy bat and windmill in accordance with claim 2, wherein said second half comprises a tubular receiver for receiving said shaft.

4. A combined toy bat and windmill comprising a toy windmill rotatably mounted in a transparent hollow toy bat through which a number of holes is formed, said hollow toy bat having a first half and a second half which are separate from each other along a plane parallel to an axis about which said toy windmill rotates.

5. A combined toy bat and windmill in accordance with claim 4, where said first half comprises a handle and a transparent head through which a number of holes are formed.

6. A combined toy bat and windmill in accordance with claim 5, where said head of said first half comprises a shaft axially formed thereon for carrying said toy windmill.

7. A combined toy bat and windmill in accordance with claim 4, where said second half comprises a handle and a transparent head through which a number of holes are formed.

* * * * *